US010160246B2

(12) United States Patent
Morimoto et al.

(10) Patent No.: US 10,160,246 B2
(45) Date of Patent: Dec. 25, 2018

(54) INFORMATION RECORDING MEDIUM

(71) Applicants: Kabushiki Kaisha Toshiba, Minato-ku (JP); Toshiba Infrastructure Systems & Solutions Corporation, Kawasaki-shi (JP)

(72) Inventors: Fumitoshi Morimoto, Shirakawa (JP); Takahisa Nakano, Kawasaki (JP); Shota Kure, Kawasaki (JP); Nobuki Nemoto, Kawasaki (JP)

(73) Assignees: Kabushiki Kaisha Toshiba, Minato-ku (JP); Toshiba Infrastructure Systems & Solutions Corporation, Kawasaki-shi (JP)

( * ) Notice: Subject to any disclaimer, the term of this patent is extended or adjusted under 35 U.S.C. 154(b) by 0 days.

(21) Appl. No.: 15/704,930

(22) Filed: Sep. 14, 2017

(65) Prior Publication Data

US 2018/0079244 A1 Mar. 22, 2018

(30) Foreign Application Priority Data

Sep. 16, 2016 (JP) ..... 2016-182300

(51) Int. Cl.
*B41J 2/475* (2006.01)
*B41M 5/34* (2006.01)
(Continued)

(52) U.S. Cl.
CPC ..... *B41M 5/34* (2013.01); *B41J 2/44* (2013.01); *B41J 2/442* (2013.01); *B41J 2/475* (2013.01);
(Continued)

(58) Field of Classification Search
CPC ... B41J 2/475; B41J 2/44; B41J 2/4753; B41J 2/442
See application file for complete search history.

(56) References Cited

U.S. PATENT DOCUMENTS

2003/0125206 A1* 7/2003 Bhatt ..... B41J 2/36 503/201
2004/0180284 A1 9/2004 Bhatt et al.
(Continued)

FOREIGN PATENT DOCUMENTS

JP 2004-216751 A 8/2004
JP 2005-7851 A 1/2005
(Continued)

OTHER PUBLICATIONS

Extended European Search Report dated Feb. 23, 2018 in European Patent Application No. 17191291.8, 7 pages.

*Primary Examiner* — Betelhem Shewareged
(74) *Attorney, Agent, or Firm* — Oblon, McClelland, Maier & Neustadt, L.L.P.

(57) ABSTRACT

An information recording medium having a front surface and a back surface has a first color developing layer, a second color developing layer and a third color developing layer. The first color developing layer develops yellow at a temperature not less than a first threshold value. The second color developing layer is arranged at the back surface side with respect to the first color developing layer. The second color developing layer develops magenta at a temperature not less than a second threshold value that is lower than the first threshold value. The third color developing layer is arranged at the front surface side with respect to the first color developing layer. The third color develops cyan at a temperature not less than a third threshold value that is higher than the first threshold value.

6 Claims, 7 Drawing Sheets

(51) Int. Cl.

| | |
|---|---|
| ***B41J 2/44*** | (2006.01) |
| ***B42D 25/23*** | (2014.01) |
| ***B42D 25/378*** | (2014.01) |
| ***B41M 3/14*** | (2006.01) |
| ***B41M 5/327*** | (2006.01) |
| ***B42D 25/00*** | (2014.01) |
| *B42D 25/405* | (2014.01) |

(52) U.S. Cl.

CPC ..... *B41J 2/4753* (2013.01); *B41M 3/142* (2013.01); *B41M 5/327* (2013.01); *B42D 25/00* (2014.10); *B42D 25/23* (2014.10); *B42D 25/378* (2014.10); *B41M 2205/04* (2013.01); *B41M 2205/42* (2013.01); *B42D 25/405* (2014.10)

(56) References Cited

U.S. PATENT DOCUMENTS

| | | | |
|---|---|---|---|
| 2005/0052521 | A1 | 3/2005 | Bhatt et al. |
| 2006/0232642 | A1 | 10/2006 | Busch et al. |
| 2006/0270552 | A1 | 11/2006 | Bhatt et al. |
| 2006/0292502 | A1 | 12/2006 | Busch et al. |
| 2008/0266373 | A1 | 10/2008 | Busch et al. |
| 2009/0096833 | A1 | 4/2009 | Busch et al. |
| 2010/0087316 | A1 | 4/2010 | Day et al. |
| 2010/0099556 | A1 | 4/2010 | Vetterling et al. |
| 2011/0018950 | A1 | 1/2011 | Busch et al. |
| 2012/0083565 | A1 | 4/2012 | Day et al. |
| 2012/0169824 | A1 | 7/2012 | Busch et al. |
| 2013/0021421 | A1 | 1/2013 | Ishikawa et al. |
| 2013/0303670 | A1 | 11/2013 | Day et al. |
| 2014/0187418 | A1 | 7/2014 | Busch et al. |
| 2017/0066251 | A1* | 3/2017 | Nemoto ..... B41J 2/435 |

FOREIGN PATENT DOCUMENTS

| | | |
|---|---|---|
| JP | 2007-296718 | 11/2007 |
| JP | 2010-234811 | 10/2010 |
| JP | 2011-143722 | 7/2011 |
| JP | 2012-76312 | 4/2012 |
| WO | WO 02/096665 A1 | 12/2002 |
| WO | WO 2011/017184 A1 | 2/2011 |
| WO | WO 2011/044049 A1 | 4/2011 |

* cited by examiner

INFORMATION RECORDING MEDIUM

CROSS-REFERENCE TO RELATED APPLICATION

This application is based upon and claims the benefit of priority from the prior Japanese Patent Application No. 2016-182300, filed on Sep. 16, 2016, the entire contents of which are incorporated herein by reference.

FIELD

Present embodiments relate to an information recording medium to be used for an identification card.

BACKGROUND

As for a recording medium in which a plurality of color developing layers having different threshold values of color developing temperatures, respectively, are laminated, when a prescribed region on a surface thereof is irradiated with laser and the color developing layer is heated, prescribed information can be recorded therein.

An information recording medium to be used such as an ID card and an IC card is configured by laminating a plurality of color developing layers having different threshold values of color developing temperatures, respectively. When, of two main surfaces of the information recording medium, one surface which is to be irradiated with laser is called a front surface, a prescribed region on the front surface is irradiated with laser and the color developing layer is heated, and thereby prescribed information can be recorded. In the information recording medium, in a case where information is printed in the form of a color image, three color developing layers of different colors are laminated. For example, when printing of the color image is realized by the three primary colors (magenta, yellow, cyan), three color developing layers which respectively develop colors at temperatures of about 100° C., about 150° C., about 200° C. are laminated inside the information recording medium, in the order distant from the front surface. The color developing layer having the color developing temperature of about 100° C. is a cyan color developing layer, the color developing layer of about 150° C. is a magenta color developing layer, and the color developing layer of about 200° C. is a yellow color developing layer.

Spacer layers having heat insulating property are arranged among the three color developing layers so as to delay heat transfer. That is, "a cyan color developing layer, a spacer layer, a magenta color developing layer, a spacer layer, a yellow color developing layer" are laminated in the information recording medium, in the order distant from the front surface. When the front surface of the information recording medium is irradiated with laser to apply heat to the color developing layers, the color developing layer to be developed can be selectively developed by varying how to apply heat for each color developing layer to be developed. Namely, that the heat generated in the vicinity of the front surface with laser irradiation is transferred to the respective layers and the temperatures of the respective layers are changed is controlled by how to apply heat with laser, that is, a laser irradiation condition, and thereby it is possible to make the respective color developing layers selectively develop colors.

For example, the spacer layer is arranged between the yellow color developing layer and the magenta color developing layer so that a temperature of the magenta color developing layer does not rise up to 150° C. when the yellow color developing layer is made at a temperature not less than 200° C. to develop a color. The thick spacer layer is arranged between the magenta color developing layer and the cyan color developing layer so that the temperature of the cyan color developing layer does not rise up to 100° C. when the yellow color developing layer is made at a temperature not less than 200° C. to develop a color, or the magenta color developing layer is made at a temperature not less than 150° C. to develop a color. It is necessary to make the spacer layer between the magenta color developing layer and the cyan color developing layer thicker compared with the other spacer layer because the heat conductivity easily becomes larger at a low temperature compared with at a high temperature. That is, it is necessary that the thickness of the spacer layer between the two color developing layers located at positions distant from the front surface is made thicker than the thickness of the other spacer layer.

Since the heat is transferred not only in the depth direction, but also in the direction along the front surface, when the cyan color developing layer located at the most distant position from the front surface among the three color developing layers is made to develop a color, heat expansion becomes large due to the thick spacer layer, and thereby it is difficult to perform high resolution printing. In addition, in order to make the cyan color developing layer selectively develop a color, it is necessary to keep the cyan color developing layer at a temperature lower than 150° C. for a long time so as to transfer heat to the cyan color developing layer through the thick spacer layer. For this reason, the printing time easily becomes long. In addition, since the color developing temperature of the cyan color developing layer is about 100° C., in a case in which the information recording medium is heated at about 100° C. when in use, unintended color development may occur, and thereby the information recording medium has the tendency for heat resistance to be low. That is, it is desired to improve the property of the information recording medium.

EMBODIMENT TO PRACTICE THE INVENTION

According to an embodiment, an information recording medium to be used for an identification card having a front surface and a back surface has a first color developing layer, a second color developing layer and a third color developing layer. The first color developing layer develops a first color at a temperature not less than a first threshold value. The first color has a minimum value of a spectral reflectivity at a first wavelength. The second color developing layer is arranged at the back surface side with respect to the first color developing layer. The second color developing layer develops a second color at a temperature not less than a second threshold value that is lower than the first threshold value. The second color has a minimum value of a spectral reflectivity at a second wavelength. The second wavelength is a wavelength that is longer than the first wavelength. The third color developing layer is arranged at the front surface side with respect to the first color developing layer. The third color develops a third color at a temperature not less than a third threshold value that is higher than the first threshold value. The third color has a minimum value of a spectral reflectivity at a third wavelength. The third wavelength is a wavelength that is longer than the second wavelength.

Hereinafter, an information recording medium to be used for an identification card according to an embodiment will be described in detail with reference to the accompanying drawings. In addition, the present invention is not limited to this embodiment. In the present specification, regarding a constituent element according to the embodiment and the description of the relevant element, a plurality of expressions may be used. The constituent element and the description which have been described by a plurality of expressions may be described by other expressions not described. Further, also the constituent element and the description which have not been described by a plurality of expressions may be described by other expressions not described.

In the embodiment, in an information recording medium 10, a color developing layer (a cyan color developing layer) having the lowest color developing temperature among three color developing layers is improved so that the color developing temperature thereof becomes the highest temperature, and the arrangement position of the color developing layer after the improvement is changed from a position that is the most distant from the front surface to a position that is the nearest to the front surface thereby improving the property of the information recording medium.

Figure 1:
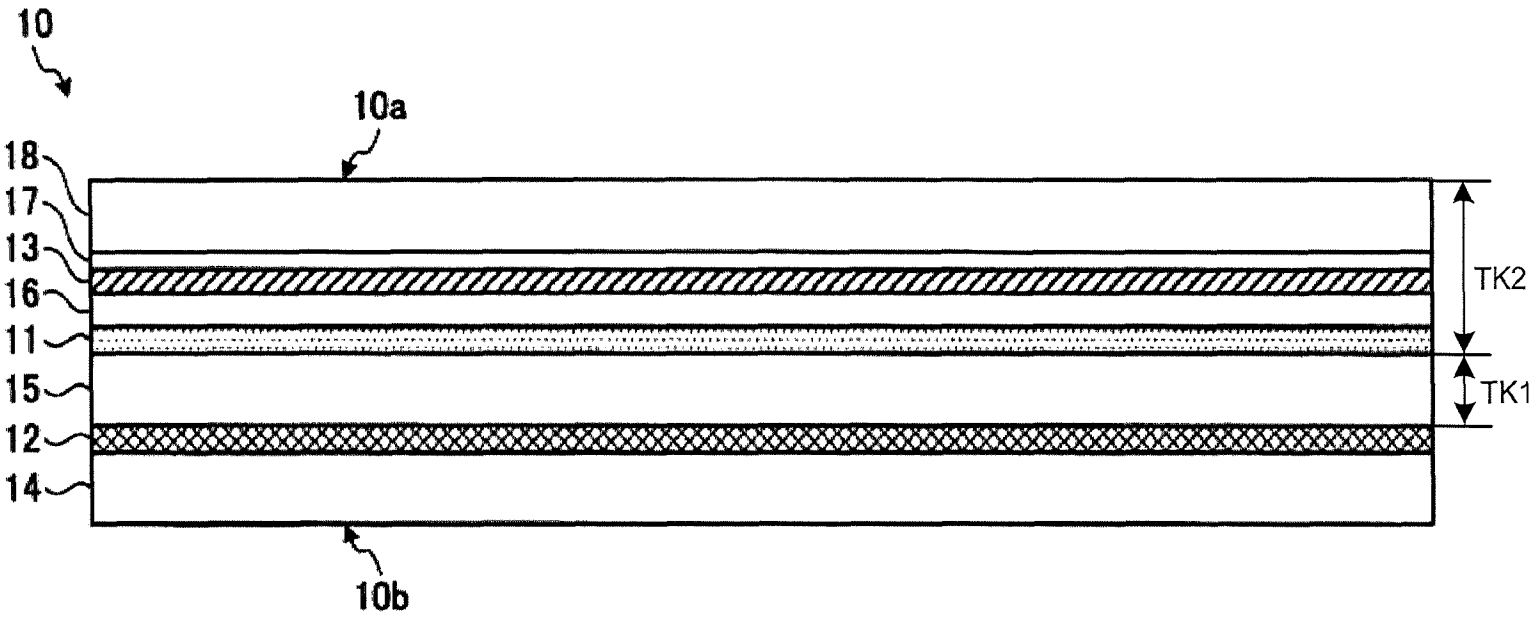
FIG. 1 is a sectional view showing a configuration of an information recording medium according to an embodiment.

The information recording medium 10 is configured as shown in FIG. 1. FIG. 1 is a sectional view showing a configuration of the information recording medium 10.

The information recording medium 10 is a member with an approximately plate-like shape, and has a front surface 10*a* and a back surface 10*b*. The information recording medium 10 has a color developing layer (a first color developing layer) 11, a color developing layer (a second color developing layer) 12, a color developing layer (a third color developing layer) 13, a substrate 14, a spacer layer (a first spacer layer) 15, a spacer layer (a second spacer layer) 16, a spacer layer (a third spacer layer) 17, and a protective layer 18. According to the information recording medium 10 of the present embodiment, a thickness TK1 of the spacer layer 15 arranged between the color developing layer 11 and the color developing layer 12 is thinner than a thickness TK2 from a surface at the back surface 10*b* side of the color developing layer 11 to a surface at the front surface 10*a* side of the protective layer 18. The spacer layer 17 is provided if necessary, and there may be a case in which the spacer layer 17 is not provided.

The color developing layer 12, the spacer layer 15, the color developing layer 11, the spacer layer 16, the color developing layer 13, the spacer layer 17, and the protective layer 18 are laminated in this order on the front surface 10*a* side of the substrate 14. The substrate 14 holds the color developing layer 12, the spacer layer 15, the color developing layer 11, the spacer layer 16, the color developing layer 13, the spacer layer 17, and the protective layer 18. The substrate 14 is made of a non-transparent material. For example, the substrate 14 can be formed of paper, polyethylene terephthalate (PET), polyester resin, glycol modified polyester (PET-G), polypropylene (PP), polycarbonate (PC), polyvinyl chloride (PVC), styrene-butadiene copolymer (SBR), poly acrylic resin, polyurethane resin, polystyrene resin.

On the other hand, each layer held by the substrate 14 is composed of a substantially transparent material in the state before color forming (printing) is performed to the information recording medium 10. After the color forming (printing) has been performed to the information recording medium 10, the formed (printed) color image is visually recognized through the protective layer 18 as superposition of the color images reflected from the respective color developing layers 11-13, with respect to a background image (of a white color or the like) reflected from the substrate 14.

The color developing layer 11 is arranged between the front surface 10*a* and the substrate 14 in the sectional view. The color developing layer 11 develops a first color. The first color is such a color as to have a minimum value of a spectral reflectivity at a wavelength (a first wavelength) $\lambda 1$. For example, when $\lambda 1 \approx 400$-$500$ nm, the first color is yellow.

Figure 2:
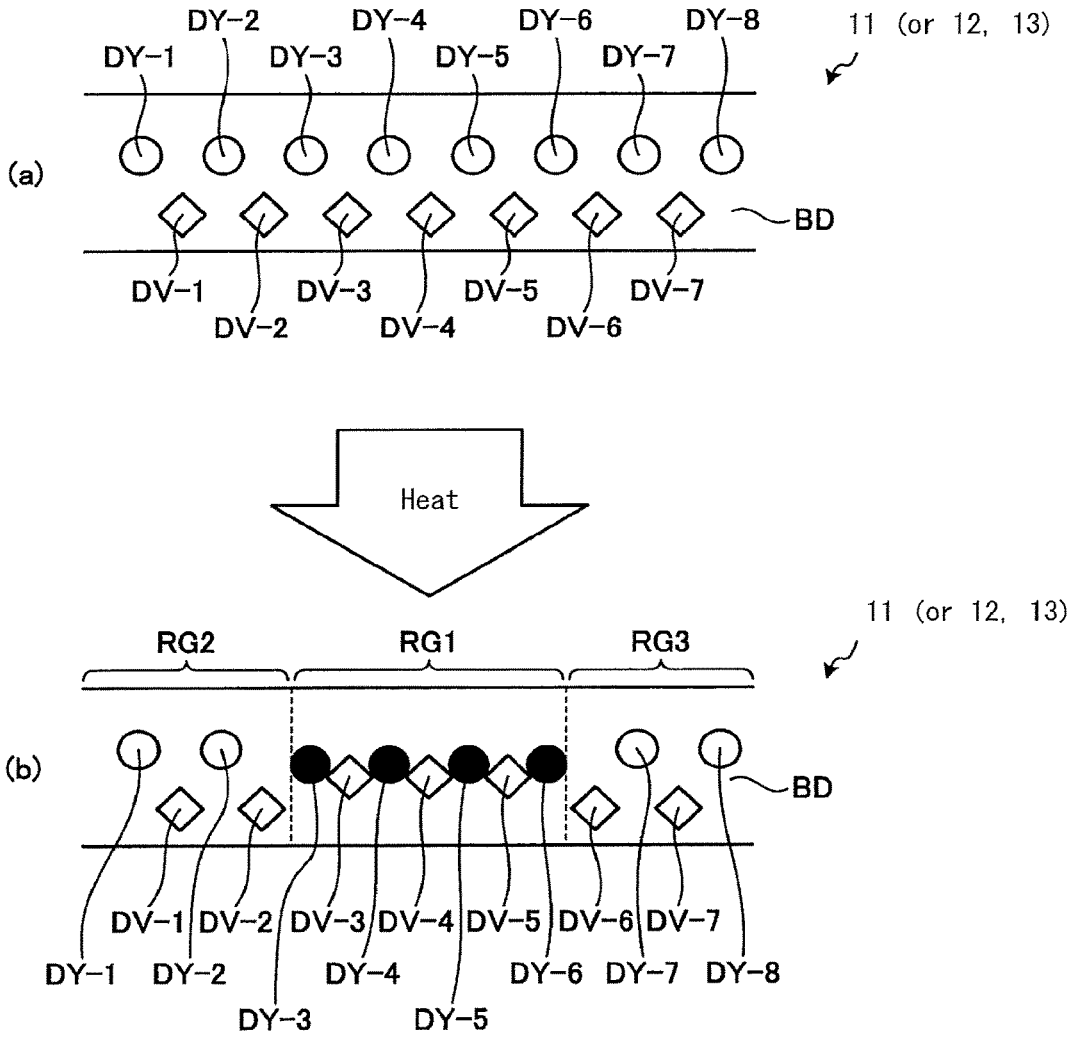
FIG. 2 is a diagram showing a configuration of the color developing layer in the embodiment.

The color developing layer 11 develops the first color at a temperature not less than a threshold value (a first threshold value) Tth1. The color developing layer 11 has a configuration shown in (*a*) in FIG. 2, for example. In FIG. 2, (*a*) is a diagram showing a configuration of the color developing layer 11 before developing a color. The color developing layer 11 has color formers DY-1 to DY-8, color developers DV-1 to DV-7, and a binder BD. The color formers DY-1 to DY-8 and the color developers DV-1 to DV-7 are dispersed in the color developing layer 11. The binder BD is arranged in the color developing layer 11 so that the color formers DY-1 to DY-8 are separated from the color developers DV-1 to DV-7.

When heat is supplied to a region RG1 in the color developing layer 11, as shown (*b*) in FIG. 2, for example, the binder BD in the region RG1 is melted and the color formers DY-3 to DY-6 come in contact with the color developers DV-3 to DV-5. When the temperature of the region RG1 becomes not less than the threshold value Tth1, the color formers DY-3 to DY-6 in the region RG1 react with the color developers DY-3 to DV-5 to develop a color. At this time, since heat sufficient to make temperatures of other regions RG2, RG3 in the color developing layer 11 not less than the threshold value Tth1 is not supplied to these regions RG2, RG3, the color formers DY-1, DY-2, DY-7, DY-8 do not develop a color. In FIG. 2, (*b*) is a diagram showing a configuration of the color developing layer 11 after having developed a color.

The binder BD is formed of resins having a high transparency, such as polyvinyl alcohol, polyvinyl acetate, polyacryl. Any of acid materials used as an electron acceptor in a thermal sensitive recording body, for example, can be used as the color developer DV. As the color developer DV, inorganic matter such as activated white earth and acid earth, inorganic acid, an organic color developer such as aromatic carboxylic acid, its anhydride or its salt of metal, organic sulfonic acid, other organic acids and a phenol series compound can be listed, and phenol series are preferable above all.

As more specific examples of the color developer DV, bis3-allyl-4-hydroxyphenyl sulfone, polyhydroxystyrene, zinc salt of 3,5-di-t-butyl salicylic acid, zinc salt of 3-octyl-5-methyl salicylic acid, a phenol series compound such as phenol, 4-phenylphenol, 4-hydroxyacetophenone, 2,2'-dihydroxydiphenil, 2,2'-methylenebis(4-chlorophenol), 2,2'-methylenebis(4-methyl-6-t-butylphenol), 4-4'-isopropylidenediphenol(another name bisphenol Λ), 4-4'-isopropylidenebis(2-chlorophenol), 4-4'-isopropylidenebis(2-methylphenol), 4-4'-ethylenebis(2-methylphenol), 4-4'-thiobis(6-t-butyl-3-methylphenol), 1-1-bis(4-hydroxyphenyl)-cyclohexane, 2,2'-bis(4-hydroxyphenyl)-n-heptane, 4-4'-cyclohexylidenebis(2-isopropylphenol), 4-4'-sulfonyldiphenyl, a salt of the relevant phenol series compound, anilide salicylate, novolac-type phenol resin, benzyl p-hydroxybenzoate and so on can be listed.

Figure 3A:
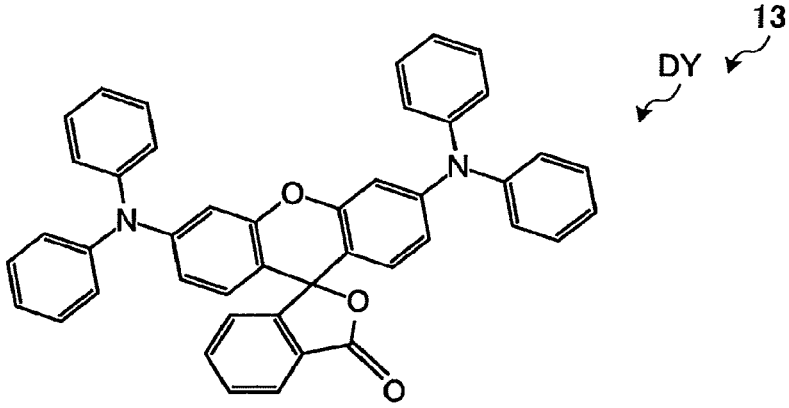
FIG. 3A, 3B and 3C are diagrams showing chemical structures of the color formers in the embodiment.
Figure 3B:
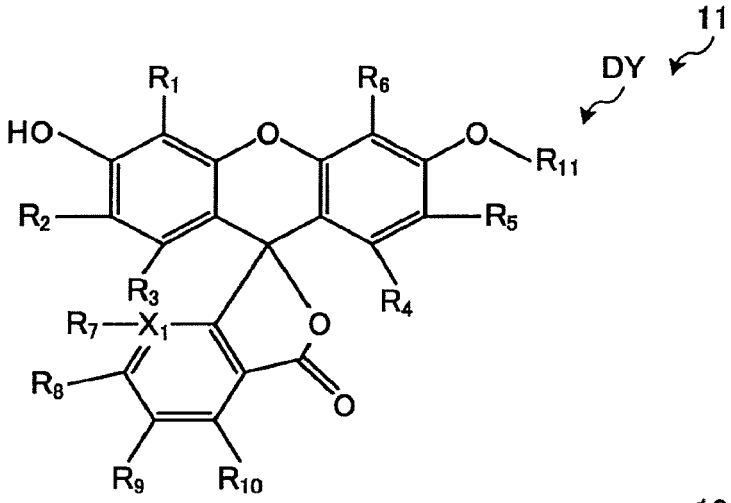

The color former DY is formed of a material which reacts with the color developer DV at a temperature not less than the threshold value (first threshold value) Tth1 to develop the first color. For example, when Tth1≈200° C., and the first color is yellow, the color former DY contains a pigment expressed by a chemical formula of FIG. 3B. FIG. 3B is a diagram showing a chemical structure of the yellow color former. In FIG. 3B, $R_1$=H, $R_2$=$C_6H_{13}$, $R_3$=H, $R_4$=H, $R_5$=$C_6H_{13}$, $R_6$=H, $R_7$=H, $R_8$=H, $R_9$=H, $R_{10}$=H, $R_{11}$=$CH_2CH_3$, $X_1$=C.

The color former DY can be formed of other material, if the other material is a material which reacts with the color developer DV at a temperature not less than the threshold value Tth1 (for example, 200° C.) to develop the first color (for example, yellow).

Returning to FIG. 1, the color developing layer 12 is arranged at the back surface 10*b* side with respect to the color developing layer 11. The color developing layer 12 is arranged between the color developing layer 11 and the substrate 14 in the sectional view. The color developing layer 12 develops a second color. The second color is such a color as to have a minimum value of a spectral reflectivity at a wavelength (a second wavelength) λ2. The wavelength λ2 is a wavelength longer than the wavelength λ1. For example, when λ2≈500-600 nm, the second color is magenta.

The color developing layer 12 develops the second color at a temperature not less than a threshold value (a second threshold value) Tth2. The color developing layer 12 has a configuration shown in (*a*) in FIG. 2, for example. In FIG. 2, (*a*) is a diagram showing a configuration of the color developing layer 12 before developing a color. The color developing layer 12 has the color formers DY-1 to DY-8, the color developers DV-1 to DV-7, and the binder BD. The color formers DY-1 to DY-8 and the color developers DV-1 to DV-7 are dispersed in the color developing layer 12. The binder BD is arranged in the color developing layer 12 so that the color formers DY-1 to DY-8 are separated from the color developers DV-1 to DV-7.

When heat is supplied to the region RG1 in the color developing layer 12, as shown (*b*) in FIG. 2, for example, the binder BD in the region RG1 is melted and the color formers DY-3 to DY-6 come in contact with the color developers DV-3 to DV-5. When the temperature of the region RG1 becomes not less than the threshold value Tth2, the color formers DY-3 to DY-6 in the region RG1 react with the color developers DV-3 to DV-5 to develop a color. At this time, since heat sufficient to make temperatures of the other regions RG2, RG3 in the color developing layer 12 not less than the threshold value Tth2 is not supplied to these regions RG2, RG3, the color formers DY-1, DY-2, DY-7, DY-8 do not develop a color. In FIG. 2, (*b*) is a diagram showing a configuration of the color developing layer 12 after having developed a color.

Materials used for the binder BD and the color developer DV are the same as those of the color developing layer 11.

Figure 3C:
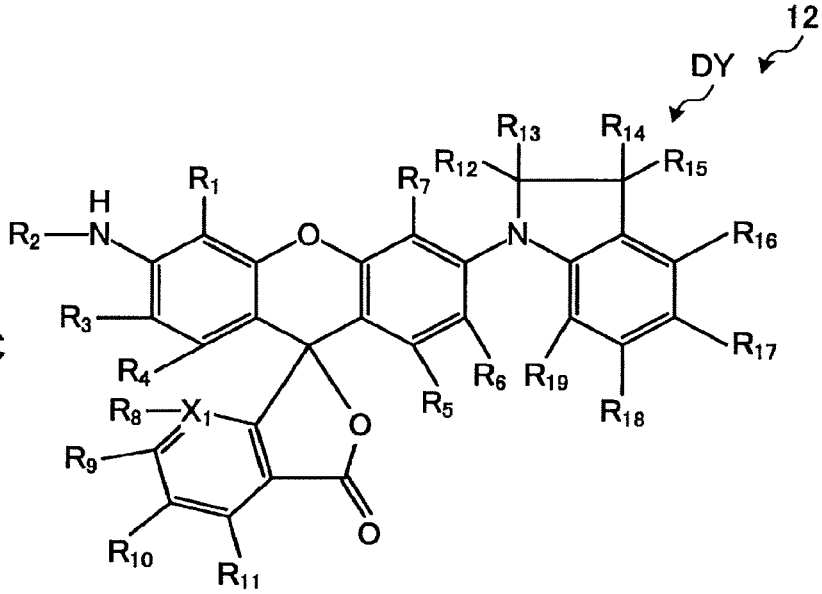

The color former DY is formed of a material which reacts with the color developer DV at a temperature not less than the threshold value (second threshold value) Tth2 to develop the second color. For example, when Tth2≈150° C., and the second color is magenta, the color former DY contains a pigment expressed by a chemical formula of FIG. 3C. FIG. 3C is a diagram showing a chemical structure of the magenta color former. In FIG. 3C, $R_1$=H, $R_2$=4-(2-hydroxy-1-dithyroxy)-$C_6H_4$, $R_3$=H, $R_4$=H, $R_5$=H, $R_6$=H, $R_7$=H, $R_8$=Cl, $R_9$=Cl, $R_{10}$=Cl, $R_{11}$=Cl, $R_{12}$=H, $R_{13}$=H, $R_{14}$=H, $R_{15}$=H, $R_{16}$=H, $R_{17}$=H, $R_{18}$=H, $R_{19}$=H, $X_1$=C.

The color former DY can be formed of other material, if the other material is a material which reacts with the color developer DV at a temperature not less than the threshold value Tth2 (for example, 150° C.) to develop the second color (for example, magenta).

Returning to FIG. 1, the color developing layer 13 is arranged at the front surface 10*a* side with respect to the color developing layer 11. The color developing layer 13 is arranged between the front surface 10*a* and the color developing layer 11 in the sectional view. The color developing layer 13 develops a third color. The third color is such a color as to have a minimum value of a spectral reflectivity at a wavelength (a third wavelength) λ3. The wavelength λ3 is a wavelength longer than the wavelength λ2. For example, when λ3≈600-700 nm, the third color is cyan.

The color developing layer 13 develops the third color at a temperature not less than a threshold value (a third threshold value) Tth3. The color developing layer 13 has a configuration shown in (*a*) in FIG. 2, for example. In FIG. 2, (*a*) is a diagram showing a configuration of the color developing layer 13 before developing a color. The color developing layer 13 has the color formers DY-1 to DY-8, the color developers DV-1 to DV-7, and the binder BD. The color formers DY-1 to DY-8 and the color developers DV-1 to DV-7 are respectively dispersed in the color developing layer 13. The binder BD is arranged in the color developing layer 13 so that the color formers DY-1 to DY-8 are separated from the color developers DV-1 to DV-7.

When heat is supplied to the region RG1 in the color developing layer 13, as shown (*b*) in FIG. 2, for example, the binder BD in the region RG1 is melted and the color formers DY-3 to DY-6 come in contact with the color developers DV-3 to DV-5. When the temperature of the region RG1 becomes not less than the threshold value Tth3, the color formers DY-3 to DY-6 in the region RG1 react with the color developers DV-3 to DV-5 to develop a color. At this time, since heat sufficient to make temperatures of the other regions RG2, RG3 in the color developing layer 13 not less than the threshold value Tth3 is not supplied to these regions RG2, RG3, the color formers DY-1, DY-2, DY-7, DY-8 do not develop a color. In FIG. 2, (*b*) is a diagram showing a configuration of the color developing layer 13 after having developed a color.

Materials used for the binder BD and the color developer DV are the same as those of the color developing layers 11, 12.

The color former DY is formed of a material which reacts with the color developer DV at a temperature not less than the threshold value (third threshold value) Tth3 to develop the third color (refer to FIG. 2 (*b*)). For example, when Tth3≈300° C., and the third color is cyan, the color former DY contains a pigment expressed by a chemical formula of FIG. 3A. FIG. 3A is a diagram showing a chemical structure of the cyan color former. The pigment expressed by the chemical formula of FIG. 3A is 3',6'-bis(diphenylamino) spiro[isobenzofuran-1(3H),9'-[9H]xanthene]-3-one. Or the pigment expressed by the chemical formula of FIG. 3A is also called lactone 2-[3,6-bis(diphenylamino)-9-hydroxy-9H-xanthene-9-yl]benzoate.

The color former DY can be formed of other material, if the other material is a material which reacts with the color developer DV at a temperature not less than the threshold value Tth3 (for example, 300° C.) to develop the third color (for example, cyan).

Returning to FIG. 1, the spacer layer 15 is arranged between the color developing layer 12 and the color developing layer 11 in the sectional view. The spacer layer 15 is configured so as to delay heat transfer from the color developing layer 11 to the color developing layer 12. The spacer layer 15 is formed of a material and in a thickness so that the temperature of the color developing layer 12 does not rise up to the threshold value Tth2 (for example, 150° C.) when the color developing layer 13 is made at a temperature not less than the threshold value Tth3 (for example, 300° C.) to develop a color, or when the color developing layer 11 is made at a temperature not less than the threshold value Tth1 (for example, 200° C.) to develop a color. The spacer layer 15 is formed of a material having heat insulating property, and can be formed of polypropylene (PP), polyvinyl alcohol (PVA), styrene-butadiene copolymer (SBR), polystyrene, polyacryl and so on, for example.

The spacer layer 16 is arranged between the color developing layer 11 and the color developing layer 13 in the sectional view. The spacer layer 16 is configured so as to delay heat transfer from the color developing layer 13 to the color developing layer 11. The spacer layer 16 is formed of a material and in a thickness so that the temperature of the color developing layer 11 does not rise up to the threshold value Tth1 (for example, 200° C.) when the color developing layer 13 is made at a temperature not less than the threshold value Tth3 (for example, 300° C.) to develop a color. The spacer layer 16 is formed of a material having heat insulating property, and can be formed of polypropylene (PP), polyvinyl alcohol (PVA), styrene-butadiene copolymer (SBR), polystyrene, polyacryl and so on, for example.

The spacer layer 17 is arranged between the color developing layer 13 and the protective layer 18 in the sectional view. The spacer layer 17 is configured so as to delay heat transfer from the protective layer 18 to the color developing layer 13. The spacer layer 17 is formed of a material having heat insulating property, and can be formed of polypropylene (PP), polyvinyl alcohol (PVA), styrene-butadiene copolymer (SBR), polystyrene, polyacryl and so on, for example.

The protective layer 18 is arranged in the vicinity of the front surface 10*a* of the information recording medium 10, to protect the respective layers in the information recording medium 10.

Figure 4:
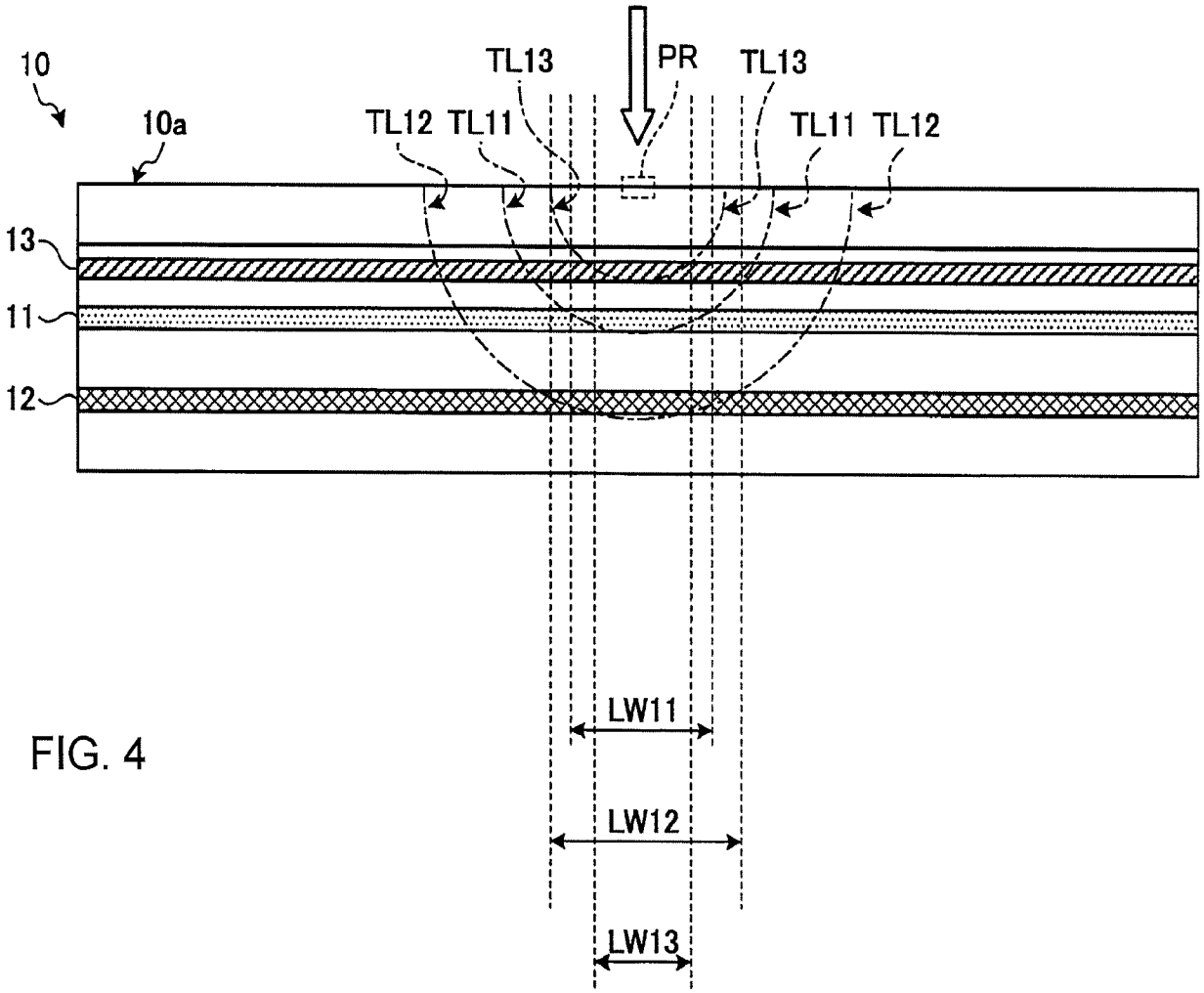
FIG. 4 is a diagram showing a temperature distribution of the information recording medium in the embodiment when the front surface is heated.
Figure 5:
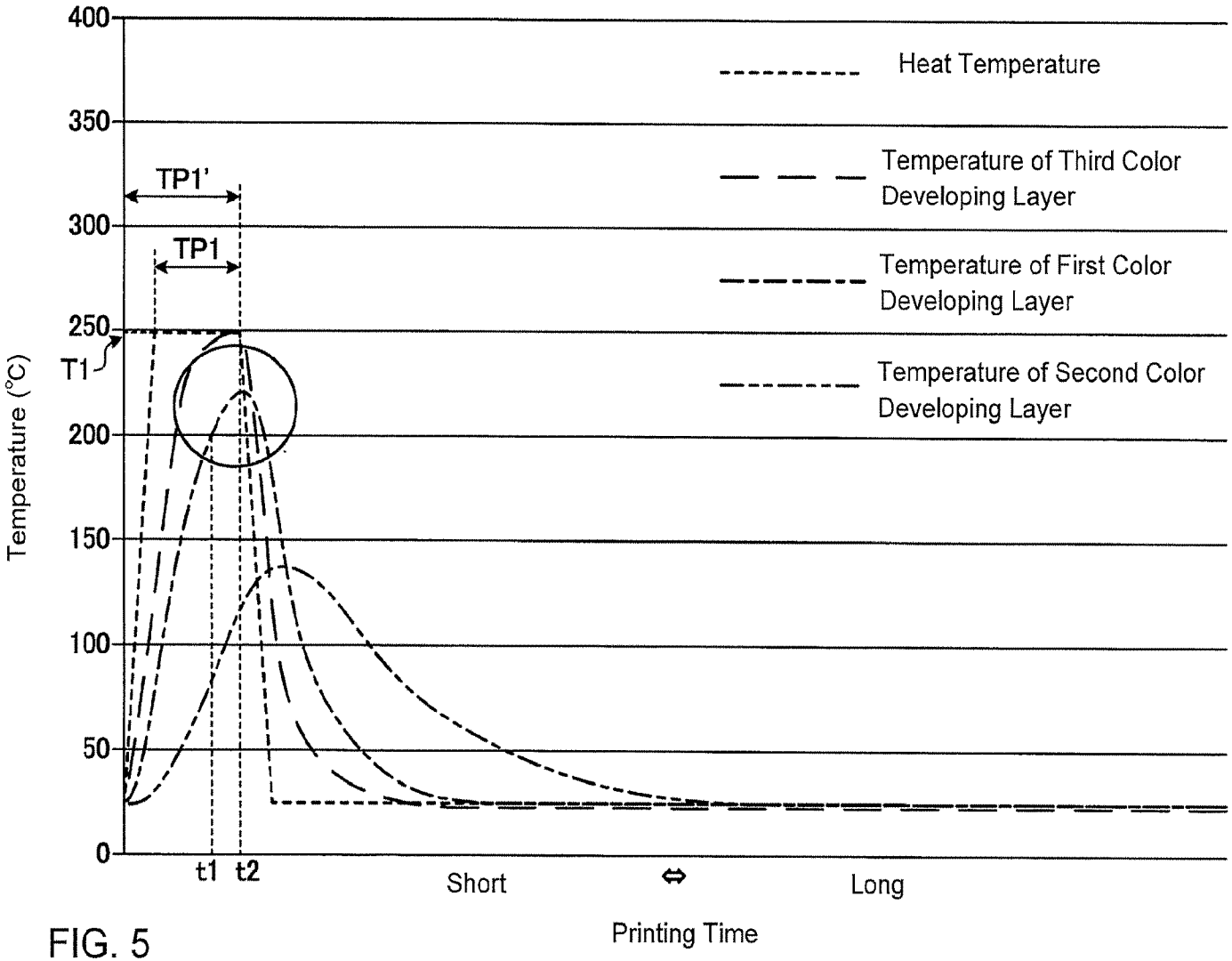
FIG. 5 is a diagram showing a heating processing for making the color developing layer of the first color in the embodiment develop a color.
Figure 6:
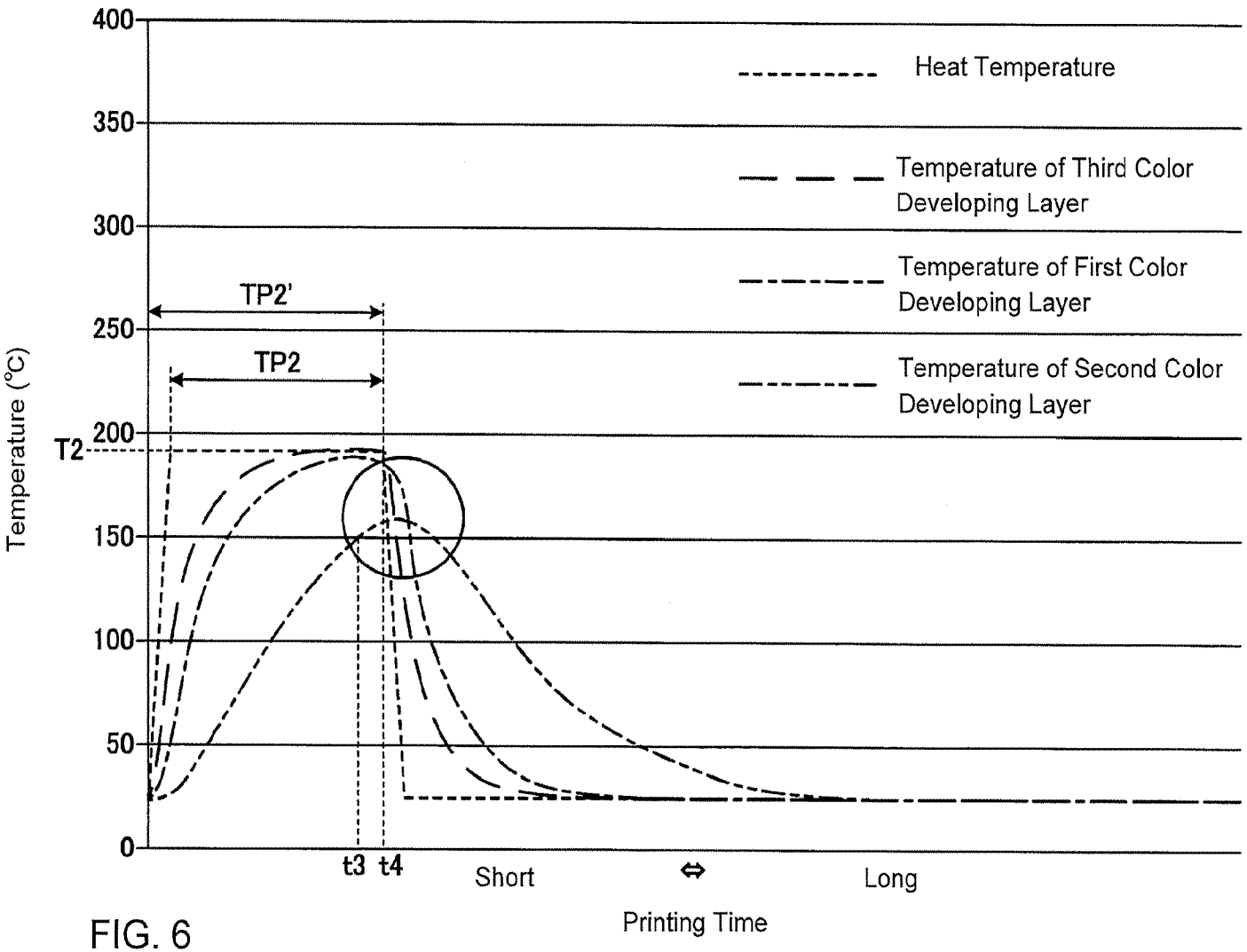
FIG. 6 is a diagram showing a heating processing for making the color developing layer of the second color in the embodiment develop a color.
Figure 7:
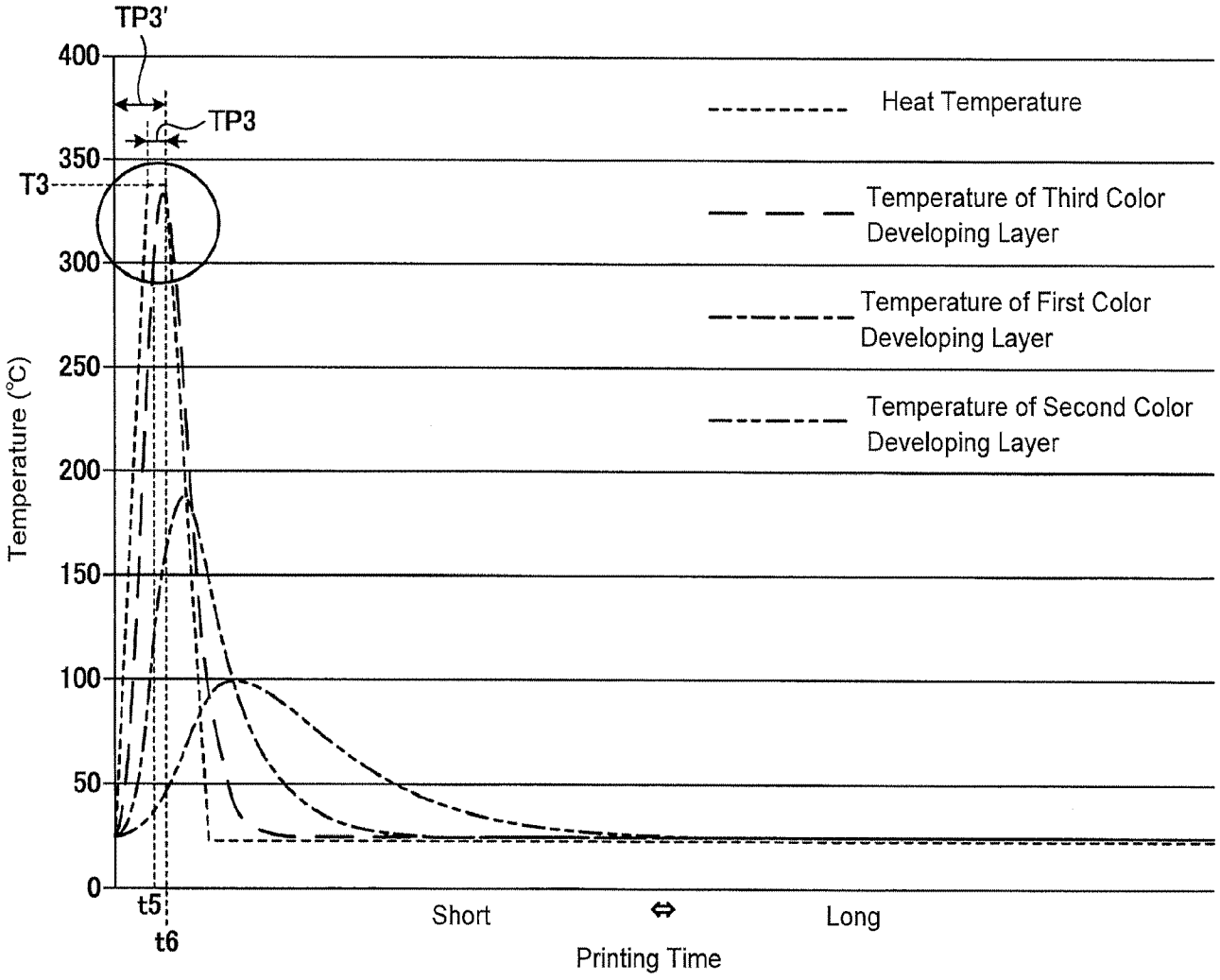
FIG. 7 is a diagram showing a heating processing for making the color developing layer of the third color in the embodiment develop a color.

Next, heating processings for making the respective color developing layers 11-13 individually develop a color will be described using FIG. 4-FIG. 7. FIG. 4 is a diagram showing a temperature distribution of the information recording medium 10 at the time of heating the surface. FIG. 5 is a diagram showing a heating processing for making the color developing layer 11 of the first color (for example, yellow) develop a color. FIG. 6 is a diagram showing a heating processing for making the color developing layer 12 of the second color (for example, magenta) develop a color. FIG. 7 is a diagram showing a heating processing for making the color developing layer 13 of the third color (for example, cyan) develop a color.

As shown in FIG. 4, when a region RR in the vicinity of the front surface 10*a* of the information recording medium 10 is irradiated with laser, heat is transferred into the information recording medium 10 taking the region RR heated with the laser as a starting point. When a line connecting regions having the same temperature in the information recording medium 10 is called an isothermal line, it is possible to indicate isothermal lines TL13, TL11, TL12 as shown in FIG. 4. At this time, (a temperature of the region RR)=(a heat generating temperature of the front surface 10*a*)>(a temperature of the isothermal line TL13)≈(a temperature of the color developing layer 13 of the third color)>(a temperature of the isothermal line TL11)≈(a temperature of the color developing layer 11 of the first color)>(a temperature of the isothermal line TL12)≈(a temperature of the color developing layer 12 of the second color). The isothermal lines TL13, TL11, TL12 are schematically shown by the respective concentric lines around the region RR in FIG. 4, but they may be lines distorted from the concentric circles around the region RR.

When the color developing layer 11 is made to selectively develop the first color (for example, yellow), it is necessary that at the time point when the temperature of the isothermal line TL11 has reached a temperature not less than the threshold value Tth1 (for example, 200° C.), the temperature of the isothermal line TL13 is less than the threshold value Tth3 (for example, 300° C.) and the temperature of the isothermal line TL12 is less than the threshold value Tth2 (for example, 150° C.). For this reason, a heating processing is performed to the information recording medium 10 as shown in FIG. 5, so that the temperature of the region RR on the front surface 10*a* of the information recording medium 10 (heat generating temperature of the front surface 10*a*) is held to a temperature T1 that is not less than the threshold value Tth1 and less than the threshold value Tth3 for a term TP1. This heating processing can be realized by irradiating the region RR on the front surface 10*a* of the information recording medium 10 with laser having a power density adjusted to PD1 for a term TP1'.

By this heating processing, the temperature of the color developing layer 11 of the first color (for example, yellow) reaches the threshold value Tth1 (for example, 200° C.) at a timing t1 within the term TP1 and the color developing layer 11 starts developing a color. And the temperature of the color developing layer 12 is suppressed to less than the threshold value Tth2 (for example, 150° C.) due to the delay of the heat transfer caused by the spacer layers 17, 16, 15 (refer to FIG. 1), at a timing t2 when the term TP1 ends and therefore the color developing layer 12 does not develop a color. At this time, the temperature of the color developing layer 13 only rises up to the temperature T1 that is less than the threshold value Tth3 and therefore the color developing layer 13 does not develop a color. By this means, it is possible to print an image of the first color (for example, yellow) which is resolvable with a minimum printing width LW11 in the information recording medium 10.

The term TP1' (=a time for the temperature of the front surface 10*a* to rise up to the temperature T1+the term TP1) is a time which is sufficiently long for the temperature of the isothermal line TL11 to reach a temperature that is not less than the threshold value Tth1, and in which the temperature of the isothermal line TL12 remains less than the threshold value Tth2 (for example 150° C.). In other words, the term TP1' can be determined as a time in which heat sufficient for the color developing layer 11 to become at a temperature that is not less than the threshold value Tth1 is transferred to the color developing layer 11, and in which heat to be transferred to the color developing layer 12 is suppressed so that the color developing layer 12 remains at a temperature that is less than the threshold value Tth2.

When the color developing layer 12 is made to selectively develop the second color (for example, magenta), it is necessary that at the time point when the temperature of the isothermal line TL12 shown in FIG. 4 has reached a temperature that is not less than the threshold value Tth2 (for example, 150° C.), the temperature of the isothermal line TL13 is less than the threshold value Tth3 (for example, 300° C.) and the temperature of the isothermal line TL11 is less than the threshold value Tth1 (for example, 200° C.). For this reason, a heating processing is performed to the information recording medium 10 as shown in FIG. 6, so that the temperature of the region RR on the front surface 10*a* of the information recording medium 10 (heat generating temperature of the front surface 10*a*) is held to a temperature T2 that is not less than the threshold value Tth2 and less than the threshold value Tth1 for a term TP2. This heating processing can be realized by irradiating the region RR on the front surface 10*a* of the information recording medium 10 with laser having a power density adjusted to PD2 (<PD1) for a term TP2' (>TP1').

By this heating processing, the temperature of the color developing layer 12 of the second color (for example, magenta) reaches the threshold value Tth2 (for example, 150° C.) at a timing t3 within the term TP2 and the color developing layer 12 starts developing a color. And at a timing t4 when the term TP2 ends, the temperature of the color developing layer 13 only rises up to the temperature T2 that is less than the threshold value Tth3 and therefore the color developing layer 13 does not develop a color. In addition, the temperature of the color developing layer 11 only rises up to the temperature T2 that is less than the threshold value Tth1 and therefore the color developing layer 11 does not develop a color. By this means, it is possible to print an image of the second color (for example, magenta) which is resolvable with a minimum printing width LW12 in the information recording medium 10.

The term TP2' (=a time for the temperature of the front surface 10*a* to rise up to the temperature T2+the term TP2) is a time which is sufficiently long for the temperature of the isothermal line TL12 to reach a temperature not less than the threshold value Tth2 and less than the threshold value Tth1. In other words, the term TP2' can be determined as a time in which heat sufficient for the temperature of the color developing layer 12 to become not less than the threshold value Tth2 is transferred to the color developing layer 12.

When the color developing layer 13 is made to selectively develop the third color (for example, cyan), it is necessary that at the time point when the temperature of the isothermal line TL13 shown in FIG. 4 has reached a temperature that is not less than the threshold value Tth3 (for example, 300° C.), the temperature of the isothermal line TL11 is less than the threshold value Tth1 (for example, 200° C.) and the temperature of the isothermal line TL12 is less than the threshold value Tth2 (for example, 150° C.). For this reason, a heating processing is performed to the information recording medium 10 as shown in FIG. 7, so that the temperature of the region RR on the front surface 10*a* of the information recording medium 10 (heat generating temperature of the front surface 10*a*) is held to a temperature T3 that is not less than the threshold value Tth3 for a term TP2. This heating processing can be realized by irradiating the region RR on the front surface 10*a* of the information recording medium 10 with laser having a power density adjusted to PD3 (>PD1) for a term TP3' (<TP1').

By this heating processing, the temperature of the color developing layer 13 of the third color (for example, cyan) reaches the threshold value Tth3 (for example, 300° C.) at a timing t5 within the term TP3 and the color developing layer 13 starts developing a color. And the temperature of the color developing layer 11 is suppressed to less than the threshold value Tth1 (for example, 200° C.) by the delay of the heat transfer caused due to the spacer layers 17, 16 (refer to FIG. 1) at a timing t6 when the term TP3 ends and therefore the color developing layer 11 does not develop a color. In addition, the temperature of the color developing layer 12 is suppressed to less than the threshold value Tth2 (for example, 150° C.) due to the delay of the heat transfer caused by the spacer layers 17, 16, 15 (refer to FIG. 1) and therefore the color developing layer 12 does not develop a color. By this means, it is possible to print an image of the third color (for example, cyan) which is resolvable with a minimum printing width LW13 in the information recording medium 10.

The term TP3' (=a time for the temperature of the front surface 10*a* to rise up to the temperature T3+the term TP3) is a time which is sufficiently long for the temperature of the isothermal line TL13 to reach a temperature that is not less than the threshold value Tth3, and in which the temperature of the isothermal line TL11 remains less than the threshold value Tth1 (for example 200° C.), and the temperature of the isothermal line TL12 remains less than the threshold value Tth2 (for example 150° C.). In other words, the term TP3' can be determined as a time in which heat sufficient for the temperature of the color developing layer 13 to become not less than the threshold value Tth3 is transferred to the color developing layer 13, and in which heat to be transferred to the color developing layer 11 is suppressed so that the temperature of the color developing layer 11 remains less than the threshold value Tth1 and heat to be transferred to the color developing layer 12 is suppressed so that the temperature of the color developing layer 12 remains less than the threshold value Tth2.

When the resolvable minimum printing widths are compared, the minimum printing width LW13 of the third color (for example, cyan) is smaller than the minimum printing width LW11 of the first color (for example, yellow), and is smaller than the minimum printing width LW12 of the second color (for example, magenta).

As described above, according to the embodiment, among the color developing layer 11 of the first color (for example, yellow), the color developing layer 12 of the second color (for example, magenta) and the color developing layer 13 of the third color (for example, cyan) in the information recording medium 10, the temperature at which the color developing layer 13 develops a color is made the highest, and the color developing layer 13 is arranged at a position that is the nearest to the front surface 10*a*. That is, compared with a configuration in which "the cyan color developing layer, the spacer layer, the magenta color developing layer, the spacer layer, the yellow color developing layer" are laminated on the substrate 14 in the order distant from the front surface, the temperature at which the color developing layer 13 of the third color (for example, cyan) develops a color is made higher, and accordingly the arrangement of the thick spacer layer can be eliminated, and thereby printing at high resolution can be realized. Accordingly, the property of the information recording medium 10 can be improved. According to the information recording medium of the embodiment, the thickness of the spacer arranged between the two color developing layers located at positions distant from the front surface can be made thinner than the thickness of the spacer layer arranged between the two color developing layers located at positions distant from the front surface in the conventional information recording medium. For the reason, according to the information recording medium of the embodiment, the thickness of the spacer layer 15 arranged between the color developing layer 11 and the color developing layer 12 is thinner than the thickness from the surface at the back surface 10*b* side of the color developing layer 11 to the surface at the front surface 10*a* side of the protective layer 18.

According to the embodiment, since the arrangement of the thick spacer layer can be eliminated, total printing times for the respective color developing layers can be shortened. Accordingly, the property of the information recording medium can be improved also from this point of view.

In the embodiment, compared with the configuration in which "the cyan color developing layer, the spacer layer, the magenta color developing layer, the spacer layer, the yellow color developing layer" are laminated on the substrate 14 in the order distant from the front surface, the lowest temperature (the threshold value Tth2 (for example, 150° C.)) out of the temperatures at which the respective color developing layers develop a color can made higher, and thereby the heat insulating property of the information recording medium 10 can be improved. Accordingly, the property of the information recording medium 10 can be improved also from this point of view.

In addition, regarding the principle of developing a color, the color developing layer (the color former DY) of each color is normally colorless (transparent) in a crystallized state, but it is amorphized (amorphous) at a temperature above the threshold value to develop a color (refer to (*b*) of FIG. 2).

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An information recording medium to be used for an identification card having a front surface and a back surface comprising:

a first color developing layer which has a minimum value of a spectral reflectivity at a first wavelength, and develops a first color at a temperature not less than a first threshold value;

a second color developing layer which is arranged at the back surface side with respect to the first color developing layer, has a minimum value of a spectral reflectivity at a second wavelength that is longer than the first wavelength, and develops a second color at a temperature not less than a second threshold value that is lower than the first threshold value; and a third color developing layer which is arranged at the front surface side with respect to the first color developing layer, has a minimum value of a spectral reflectivity at a third wavelength that is longer than the second wavelength, and develops a third color at a temperature not less than a third threshold value that is higher than the first threshold value.

2. The information recording medium to be used for an identification card according to claim 1 wherein:

the first color is yellow;

the second color is magenta; and the third color is cyan.

3. The information recording medium to be used for an identification card according to claim 2 wherein:

the third threshold value is 300° C.;

the first threshold value is 200° C.; and the second threshold value is 150° C.

4. The information recording medium to be used for an identification card according to claim 2 further comprising:

a first spacer layer arranged between the first color developing layer and the second color developing layer;

a second spacer layer arranged between the first color developing layer and the third color developing layer; and a protective layer arranged at the front surface side with respect to the third color developing layer;

wherein a thickness of the first spacer layer is thinner than a thickness from a surface at the back surface side of the first color developing layer to a surface at the front surface side of the protective layer.

5. The information recording medium to be used for an identification card according to claim 4 further comprising:

a third spacer layer which is arranged between the third color developing layer and the protective layer.

6. The information recording medium to be used for an identification card according to claim 1 wherein:

the third color developing layer contains a pigment expressed by a chemical formula described below:

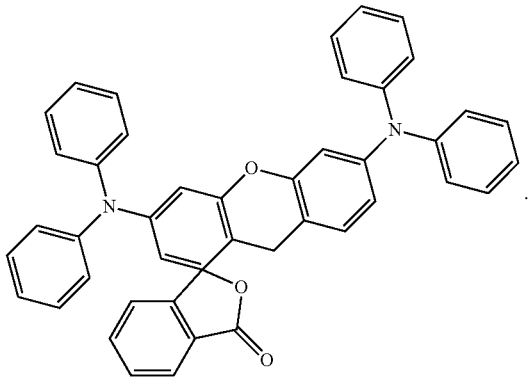

* * * * *